United States Patent [19]

Lauchenauer

[11] Patent Number: 4,904,273

[45] Date of Patent: Feb. 27, 1990

[54] FOAM TREATMENT

[75] Inventor: Alfred E. Lauchenauer, Horn, Switzerland

[73] Assignee: Adnovum AG, Switzerland

[21] Appl. No.: 23,121

[22] PCT Filed: Apr. 21, 1986

[86] PCT No.: PCT/EP86/00242

§ 371 Date: Dec. 12, 1986

§ 102(e) Date: Dec. 12, 1986

[87] PCT Pub. No.: WO86/06424

PCT Pub. Date: Nov. 6, 1986

[30] Foreign Application Priority Data

Apr. 23, 1985 [GB] United Kingdom ..... 8510296

[51] Int. Cl.[4] ..... D06L 3/06

[52] U.S. Cl. ..... 8/108.1; 8/101; 8/111; 427/373

[58] Field of Search ..... 8/108.1, 101, 111, 477; 427/294, 296, 373

[56] References Cited

U.S. PATENT DOCUMENTS

| | | | |
|---|---|---|---|
| 4,099,913 | 7/1978 | Walter et al. | 8/477 |
| 4,288,475 | 9/1981 | Meeker | 427/294 |

FOREIGN PATENT DOCUMENTS

| | | | |
|---|---|---|---|
| 3419367 | 11/1984 | Fed. Rep. of Germany . | |
| 2177914 | 11/1973 | France . | |
| 2258486 | 8/1975 | France . | |
| WO841970 | 5/1984 | PCT Int'l Appl. | 8/477 |
| 1585874 | 3/1981 | United Kingdom . | |

*Primary Examiner*—Paul Lieberman
*Assistant Examiner*—John F. McNally
*Attorney, Agent, or Firm*—Ostrolenk, Faber, Gerb & Soffen

[57] ABSTRACT

The invention teaches the treatment of a porous substrate such as a textile material by treating the substrate with a foam, the substrate prior to treatment having a moisture content of up to 130% of the transit water content, forcing the foam into the porous substrate to enable foam transit through said substrate, causing or allowing foam collapse both at the surface interface and at the interior interface and terminating the treatment by removing or deactivating the reagent.

10 Claims, No Drawings

FOAM TREATMENT

DESCRIPTION

The present invention relates to the foam treatment of porous substrates and has particular reference to the foam treatments of textile materials.

Our European Patent No. 47058 describes and claims a method of treating a surface with reagents, which method comprises establishing a reagent in a liquid phase, forming a foam of the liquid phase, applying foam to the surface to be treated and causing or allowing the foam to collapse at the interface with the surface being treated to deposit the reagent thereon, and thereafter removing or deactivating the reagent on said surface when the treatment is completed, whereby the rate of foam collapse is controlled to control the rate of application of the reagent to the surface.

The process forming the subject of this European Patent has been found to be highly beneficial and constitutes a major advance in the art of the treatment of substrates.

The careful control that can be exercised over the amount of reagent applied to a substrate surface has been improved considerably by this invention, but nevertheless the results obtained with this invention still suffer, to some extent, from the disadvantage that there is uneven treatment through the depth of the substrate per se. European Patent No. 47058 describes the application of foam to a surface. The specification then teaches the collapse of the foam upon that surface in a controlled manner to allow release of reagent onto the surface. Thus, the surface areas of the substrate are treated in a controlled manner, but depending upon the variations in the porosity of the substrate, the reagent may or may not permeate into the interstices of porous substrate, thus producing a possible uneveness of effect.

The present invention seeks to overcome this disadvantage by providing an interaction between a reagent not only on the surface of the material, but also within the interstices of the substrate being treated.

According to the present invention, therefore, there is provided a method of treating a porous substrate with a reagent, which method comprises (i) establishing the reagent in a liquid phase,
(ii) forming a foam of the liquid phase,
(iii) contacting said foam with a porous substrate to be treated having a moisture content upon treatment with the foam of up to 130% of the foam transit water content as herein defined thereby surface interfaces and interior interfaces, between foam and substrate
(iv) forcing said foam into said porous substrate under conditions which enable foam transit through said substrate,
(v) causing or allowing the foam to collapse both at the surface interface and at the interior interfaces and
(vi) terminating the treatment on completion thereof by removing or deactivating the reagent.

The foam is preferably a stable foam having a blow ratio within the range of 5 to 80, preferably 10 to 50. The porous substrate may be substantially dry on treatment with the foam or may have a moisture content within the range of the foam transit water content ± 30%.

The termination of the treatment may be effected by treatment of the substrate with a heat transfer medium such as, for example, a vapour or gas having a temperature of at least 100° C. In one embodiment of the invention, the reagent may be a bleaching agent.

For the purposes of this specification, the expression "foam transit water content" (FTWC) of a porous substrate is the water content of that substrate, expressed as a percentage of the substrate's dry weight, when a foam containing a treatment agent is passed through a dry porous substrate material substantially perpendicular thereto under the action of a pressure gradient until foam starts to exit from the other side thereof. The determination of the foam transit water content may be effected by preparing a dried sample of the porous material, placing the material on a filter plate of a funnel, covering it with an excess of foam in accordance with the invention, applying strong vacuum to suck foam through the material and removing the sample immediately after the foam has disappeared from the upper side of the sample, determining the amount of liquid present in the sheet material after such treatment as a percentage of the dry weight of the material before the application of the foam.

It will be appreciated from the foregoing that the concept of the invention is to provide reagent in the foam not only at the surfaces of the material to be treated, but also internally thereof and to ensure that substantially uniform application takes place by the application of the foam across a pressure gradient to the material.

The reagent may be soluble in the liquid phase or may be in the form of a suspension either solid or liquid in the phase provided the resultant liquid phase is capable of being formed and at the same time the foam material is capable of being forced into the porous substrate without substantial separation of any suspended reagent components.

The foam is made to permeate the sheet material, into the interstices between the structural elements of the sheet material thus forming interfaces between foam and material both at the surface and at the interstices of the material. The foam is caused to collapse incrementally by the application of, for example, a foam destabilising agent such, for example, as a heat transfer agent. The sheet material may contain an amount of water when the foam is applied to it which is not more than 30% preferably not more than 20% lower and not more than 50%, preferably not more thatn 30% higher than the foam transit water content.

When a porous material has a foam transit water content determined in the manner described above, the material contains little if any liquid water in the intestices between its structural elements while the sheet itself has absorbed the amount of water it can hold in full adsorbed form, i.e., in a swollen state. This provides ideal conditions for making use of the incremental release of reagent in accordance with the method described herein. If the porous material contains a smaller amount of water it will initially adsorb water from the foam causing possibly premature foam collapse and in some cases high reagent concentrations released into the material at both the surface interface and at the inner interfaces. If the material contains a substantially higher amount of liquid than the foam transit water content level, then only water will be present in the intestices and the inner interfaces will be only partly available for action/reaction by the reagent.

The inner interfaces between the foam and the substrate can only form if the foam is not speedily destroyed by the liquid forming the cell walls of the foam when the foam is forced into the interior of the substrate structure. Since the inner surface usually is larger than the surface interface (sometimes by a factor of 10 or more) conditions should preferably be provided and maintained which will prevent or at least reduce the possibility of premature foam breakdown, which latter would prevent the formation of foam to substrate interfaces.

It will be appreciated by the man skilled in the art that these conditions will depend on the intrinsic absorbancy of the substrate, but more so on the actual absorbancy of the substrate for the liquid present in the foam. These conditions will vary widely for different substrates and will also depend on the pretreatments which the substrate has undergone, particularly where these pretreatments themselves effect the absorbancy. They will also depend on the structure of the substrate and on the liquid already present therein.

If the actual absorbancy of the substrate is too high, foam liquid will be very quickly absorbed, the foam will collapse and no substantial interface will form until saturation has been reached. If too much liquid is already present in the substrate, foam forced into the interior of the substrate structure has no space to go to form an interface and excessive dilution and destabilisation will occur in the process.

If the porous substrate to be treated is wet from previous treatments, a dewatering treatment according to the process described in PCT Application EP83/00292 will in one step reduce the water content and establish FTWC conditions. One may in this dewatering treatment use a foam consisting essentially of water, or a foam containing all or some components of the reactive formulation to be applied subsequently, or an agent having a beneficial effect on subsequent treatments. The same applies to the treatment of a dry substrate, where a treatment with a foamed bath sucked or pressed through the substrate will not only establish FTWC conditions, but may also be used to apply agents benefitting subsquent treatments.

The foam transit water content thus appears to depend on the degree of absorbency of the fibrous material forming the porous substrate which in turn is determined by intrinsic fibre properties and/or previous treatments which effect absorbency.

The capability of a fabric structure to form a fibre-to-foam interface at water content levels substantially higher than the FTWC value is limited by the amount of liquid water present on and between individual fibres and yarns (i.e. of water not absorbed by the fibre material and thus not removable for instance by spinning). Such liquid water affects fibre/yarn to foam interface formation in two ways: being present in the foam and the fibre. If present in substantial amounts, it reduces the space available for foam within the fabric structure.

The best results, as regards the margin of processing safety in the present invention, the area of interface at which agents applied in the form of a foam can interact with the fibre material, and the rate of interaction, are obtained if the foamed formulation is applied to porous or textile substrates having a minimum water content of not less than the FTWC value (in percent of water on the weight of the textile material) minus 10% and a maximum water content of not more than the FTWC value plus 50%, preferably plus 25% and if the foam containing the agent is forced into the textile structure by mechanical means before one quarter of the total time of interaction has elapsed.

Suitable means for forcing the foam into the substrate include vacuum applied to the side opposite the surface to which the foamed agent has been applied, or mechanical pressure applied for instance by means of a knife or a roller positioned over the width of a moving substrate sheet in such a way that a force vertical to the plane of the sheet develops and pushes the foam into the sheet. In certain cases blowing a gaseous medium (air of vapour) against the foam layer deposited on the sheet or substrate surface has been found useful, particularly if the medium also can serve as heating medium. If vacuum is used to force the foam into the substrate structure, and if the vacuum is sufficiently strong, foamed agent will come through the fabric structure, i.e. it will enter the fabric and exit from it in the form of foam, indicating that an inner fibre/yarn-to-foam interface has formed.

The foam containing the reactant may, if desired, also be applied to more than one layer of textile sheet material. It may after having been applied to the surface on one or several layers be covered by one or several layers of sheet material, i.e. it may be used in the form of a sandwich configuration. In this latter case the heat transfer medium may be applied to both sides of the sandwich.

The collapse of the foam may be gradual and/or progressive. Causing the foam to "collapse gradually" means that foam is preferably present through the entire time of interaction between the reagent and textile sheet material. This allows the reagent to be released incrementally. Reagent removal by intersection and reagent release by foam collapse thus proceed somewhat simultaneously and in a balanced way. No large excess of reagent is released at any given time during interaction thus preventing possible damage to fiber material. It will be apparent that the foamed state of the bath should preferably be maintained to such a degree and for such a time that reagent release through foam collapse is incremental.

The term "active heat transfer vapour" used throughout this specification means a gaseous heat transfer agent such as a vapour which is capable of transferring heat not only in the sense that its temperature is lowered when it contacts a colder substrate, but which also releases additional calories by condensing (i.e. by returning from the gaseous to the liquid state) at a temperature at least as high as the temperature at which interaction between the agents in the foamed bath and the substrate should take place.

Vapourised water in the form of steam or superheated steam (i.e. steam having a temperature above the boiling point of water) is particularly useful and effective due to the high level of heat of condensation released on condensation to the liquid phase and due to the fact that as a result of condensation, it prevents drying out of the foam and the textile sheet material, thus effectively preventing any scorching or thermal degradation which might result if, for instance, hot air is used as a gaseous heat transfer agent, or if heat is transferred by radiation or contact with hot surfaces.

Particularly good results are obtained if water vapour, preferably having a temperature higher than the boiling point of water, is used as an active heat transfer vapour.

The invention enables agents, such as a peroxide bleaching bath, to be applied to a wet textile structure without predrying and without having to worry about the exact amount of water present in the fabric (because this amount does not affect the add-on of bleaching agent as in the case of padding onto a wet fabric). This is an important advantage since in most cases a wet treatment precedes the bleaching/boil off sequence. If, however, the fabric to be treated is dry, one may still work under the conditions specified above, either by applying the foamed agent and forcing it into the dry fabric until the foam reaches the opposite face of the fabric or exits therefrom. In such a case, the FTWC value would be reached, leaving a layer of foam on either or both sides sufficient to feed the inner interface with an amount of reagent solution sufficient to achieve the desired effects. Alternatively, the fabric may be moistened to the FTWC level in the way described before.

The process according to the invention may provide, for instance, a very versatile, high speed, bleaching-/boil-off process.

In a typical peroxide bleaching treatment, hydrogen peroxide may be applied (together with sodium hydroxide in the usual concentrations) in the form of a foam to textile sheet material, which has a water content of not less than the FTWC value (in percent of the fabric weight), minus 10 percent and not more than the FTWC value plus 50 percent. Preferably water content is the FTWC value plus or minus 10 percent. The foam is forced into the fabric structure by mechanical means while subjecting the fabric to a heat treatment with an active heat transfer medium having a temperature higher than the reaction temperature to be maintained. In some embodiments (in particular if the fabric contains many cotton seeds) this procedure is followed by a treatment which comprises applying, for example, foamed caustin of a concentration sufficient to bring the alkali content on the fabric to a strength usually used for boil-off treatments, and/or steaming in a conventional steaming chamber. Thereafter fabric maybe washed in a usual way. An after-steaming process in presence of caustic not only removes cotton seeds completely, but also serves as a further boil-off treatment which effectively removes any remaining impurities and coloured matter present in the primary wall of the cotton.

The procedure permits full use of any peroxide still present after the peroxide bleaching treatment until it is completely consumed, and the peroxide present in the boil-off treatment prevents yellowing.

If desired, the procedure may be reversed, i.e. the boil-off treatment in presence of relatively high amounts of alkali may preceed the peroxide bleaching step. To obtain even higher processing speeds, a cold chlorine bleaching step may be carried out prior to the peroxide bleaching and boil-off steps, the chlorine bleaching agent (hypochlorite) being applied in a conventional way by padding or in the form of a foam to the fabric which may be dry or wet. A special form of this chlorine/peroxide bleaching sequence comprises applying acid to the fabric, then applying a foamed sodium hypochlorite bleaching bath to the surface of the fabric which has a water content in the range specified above for the process according to the invention, forcing the foam into the fabric structure and removing the chlorine bath at least partly before the next step, which may be the peroxide bleaching or the boiloff step. The concentration of the acid on the fabric is such that pH on and within the fabric does not exceed 5, preferably not higher than 4, throughout the chlorine bleaching treatment. This variation of the sequence not only enables limitation of the total treatment time for the entire sequence to less than three minutes, but also removes completely the hazard of catalytic damage which may occur in peroxide bleaching treatments if iron or some other metals are present in the cloth in sufficient quantities and in suitable form (metallic, as salts, hydroxides or oxides).

Particularly high speeds in the bleaching step are obtained if the heat treatment is carried out by applying steam having a temperature above the boiling point of water to a textile substrate, preferably blowing it against the surfaces of the textile sheet material. Bleaching times below 30 or even 10 seconds thus may be achieved, particularly if a chlorine bleching step had been applied as described and/or a steaming step follows.

Such a sequence requires a very low volume of baths and low total energy input, while processing speeds may be 100 meters minute or even higher. The process according to the invention, including the bleaching boil-off sequence described above, may also be applied to the pretreatment (bleaching, boiling-off, removal of cottom seeds) of cottom fibre stock. In this case the fibres—arranged in the form of a web such as a card web—are preferably carried between screens having the function of conveyor-belts, the foamed agents being applied through one of the screens (preferably the upper one) and forced into the web for instance by applying a vacuum from the opposite side. Before the first application of a foamed agent, prewetting to approximate the FTWC level for instance with an aqueous foam has been found advantageous.

The treatments according to this invention may be applied to porous sheet material including textile sheet material. Material such as loose fibres, fibre bundles and filamentous material arranged in a sheet-like configuration. Agents caused to interact with such porous sheet material comprise compounds reacting with the sheet material or components thereof, agents which interact with substances present on such material (e.g. substances which have to be removed from fibrous material, or compounds which have to interact with the sheet material or components thereof).

Following is a description by way of example only of methods of carrying the invention into effect.

EXAMPLE 1

1.1 A 100% cotton poplin in grey state (120 grams per sq. meter was desized and washed to remove residual size. It then was squeezed to leave only a water content of 55% in the fabric. The foam transit water content of the fabric had been found to be 48%. This fabric was treated as follows in wet state as specified above.

A bath containing 45 grams per liter of sodium hydroxide, 4 grams per liter of a wetting and foaming agent Sandozin NIT conc.

8 grams per liter of a scouring agent (Kieralon KB)

50 ml of hydrogen peroxide (40% strength)

was converted into a foam in a conventional static foamer (foaming rate 35 to 1).

A layer of this foam (thickness 5mm) was applied by means of a knife-over-roll system to the fabric which was close to FTWC value. The foam layer then was partially pressed into the fabric structure by means of a knife arranged in width direction in a 30° angle to the plane of the fabric, the distance between this knife and the fabric (gap) being the gap of the first knife minus about twice the thickness of the fabric. A thin layer of the foam thus was squeezed into the fabric structure.

1.2 In another trial with the same fabric and the same formulation the fabric exiting from the desizing bath was brought to about the FTWC level by dewatering it with a foam consisting of a 1 to 3 dilution of the bleaching/scouring bath described above (foaming rate 30:1) according to the method described in our European Application No. EPC 83903512.8. To the fabric thus brought to about the FTWC level the foamed bleaching/scouring bath described under (1.1) was applied in the same way, i.e. by knife-over-roller application.

To effect scouring and bleaching, superheated steam was blown against the side of the fabric not coated with foam (pretreated as described under 1.1 and 1.2). The temperature of the steam was 170° C., interaction time 30 seconds.

The samples thus treated showed an adequate degree of whiteness and good wetting properties. By after-steaming for 3 minutes in a conventional steamer, some light improvement of the white was obtained. No difference between the two samples 1.1 and 1.2 was observed.

EXAMPLE 2

The same fabric, pretreated as in Example 1.2 to achieve foam transit water content conditions, was coated with the same layer of foam, but another layer of the same fabric (pretreated in the same way) was superimposed on the foam, i.e. the foam was sandwiched between the two fabrics. Superheated steam was blown for one minute from below against the side of the bottom fabric not coated with foam.

After the same length of treatment, both fabrics showed about the same degree of whiteness and the same absorbency, and these properties were about equal to those obtained with the single-strand treatment described in Example 1.

EXAMPLE 3

Example 2 was repeated, but two strands of the poplin (pretreated as described) were superimposed on the foam layer. After the same treatment with super-heated steam (one minute) all three fabrics showed about the same effects as regards whiteness and absorbency as those of Examples 1 and 2.

EXAMPLE 4

Example 3 was repeated, but two strands of the poplin (pretreated as described in Example 1.2 were coated with the foamed formulation, and two strands of the poplin were superimposed on the foam layer.

After superheated steam had been blown against the bolten strand of the bottom layer for one minute, it was found that this bottom strand showed a lower whiteness than the other three strands, which were about identical in properties to samples obtained in Examples 1 to 3.

EXAMPLE 5

Example 4 was repeated, but superheated steam was blown both against the bottom strand of the bottom layer and the top strand of the top layer. Uniform and good absorbency and whiteness was obtained on all four strands.

EXAMPLE 6

Example 5 was repeated, but all four strands of fabric were dewatered and brought to about FTWC levels after desizing and wshing all at the same time by sucking a foam containing only 4 grams of a nonionic foaming agent and 4 grams of the scouring agents mentioned in Example 1 through the four strands of fabric.

After applying the foamed bath as described in Examples 2 to 5 and blowing superheated steam to both sides of the sandwich, a good white and good absorbency was observed on all four strands.

EXAMPLE 7

Ramie fibre bundles produced by separating the bundles from stem material and cutting to a length of not more than 20 to 30 cm were arranged essentially in single layer configuration on a screen-like conveyor belt. They were brought to FTWC condition by applying a layer of foam consisting of the same bath as in Example 1, but without peroxide, and sucking this foam through the sheet of fibre bundles, then the same foamed formulation (blow ratio 30:1) was applied to the surface of the fibre bundles, forced into interstices by mechanical means while leaving a layer of foam 5 millimetres thick on the surface. Superheated steam was then applied to the porous conveyor belt in a steamer followed by a passage through the steamer where steam heated the sheet material from both sides.

After a treatment time of 7 minutes, an aqueous foam containing a dispersing agent was sucked through the material in three steps, then another foamed formulation identical to the one mentioned in Example 1 was applied to the surface of the fibre bundles, forced into interstices by mechanical means leaving 5 millimetres of foam on the surface. The steaming treatment used in the first step was repeated for a period of 10 minutes, then the fibre bundles were thoroughly washed and dried. The ramie bundles by this treatment were degummed and bleached.

I claim:

1. A peroxide bleaching method for a textile substrate, said method comprising the steps:

(a) providing a substrate having a water content of not more than about 30% below and not more than about 50% above a Foam Transit Water Content applicable to said substrate.

(b) preparing an alkaline hydrogen peroxide composition;

(c) preparing a foam of said composition;

(d) applying said foam to said substrate under pressure; and (e) subjecting said substrate to a heat treatment process with an active heat transfer medium having a temperature higher than that of said foam-containing substrate.

2. The method according to claim 1 wherein said heat treatment process comprises deactivating said composition.

3. The method according to claim 1, wherein said heat transfer medium has a temperature of at least about 100° C. and is capable of condensing upon contact with said substrate.

4. The method according to clam 1, wherein said heat treatment process comprises removing said composition from said substrate.

5. The method according to claim 1, wherein said foam is stable and has a blow ratio between about 5 and about 80.

6. The method according to claim 1, wherein said foam is forced into the interior of said substrate by applying a vacuum to a surface of said substrate remote from said foam.

7. The method according to claim 1, wherein said foam is forced into the interior of said substrate by exerting pressure on said foam in a direction toward said substrate.

8. The method according to claim 7, wherein said pressure comprises mechanical pressure.

9. The method according to claim 7, wherein said pressure comprises gas pressure.

10. The method according to claim 1, wherein, prior to the application of said foam, said substrate is pretreated with an acid in aqueous solution and subsequently treated with a chlorine bleaching agent, the water utilized in said pretreatment providing said substrate with a water content of not more than about 10% below and not more than about 50% above said foam transit water content of said substrate.

* * * * *